US007427258B2

(12) United States Patent
Schmauder

(10) Patent No.: US 7,427,258 B2
(45) Date of Patent: Sep. 23, 2008

(54) COUNTER-ROTATING SPINDLE TRANSMISSION

(75) Inventor: Frank Schmauder, Metzingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 11/563,528

(22) Filed: Nov. 27, 2006

(65) Prior Publication Data

US 2007/0101840 A1 May 10, 2007

Related U.S. Application Data

(63) Continuation of application No. PCT/EP2005/005634, filed on May 25, 2005.

(30) Foreign Application Priority Data

May 27, 2004 (EP) ..... 04012521

(51) Int. Cl.
*B23Q 3/155* (2006.01)

(52) U.S. Cl. ..... 483/56; 483/28; 483/29; 83/13; 83/523; 83/669

(58) Field of Classification Search ..... 483/28, 483/29, 56, 1, 15, 32, 37; 29/563; 409/231, 409/131; 83/13, 523, 684, 914, 669, 640, 83/405, 515, 518, 667; 72/324, 333, 343, 72/355.4

See application file for complete search history.

(56) References Cited

U.S. PATENT DOCUMENTS 3,174,378 A * 3/1965 Friedland et al. ..... 83/526
4,197,772 A * 4/1980 Anderson et al. ..... 83/63
4,587,874 A * 5/1986 Lupke et al. ..... 409/131
4,869,626 A * 9/1989 Kosmowski ..... 409/231
5,317,893 A * 6/1994 Eigenmann et al. ..... 72/450
5,350,347 A * 9/1994 Fujiwara et al. ..... 483/29
5,956,253 A * 9/1999 Gottschalk ..... 700/186
6,055,903 A * 5/2000 Eigenmann ..... 72/446

(Continued)

FOREIGN PATENT DOCUMENTS

JP 04-105793 4/1992

(Continued)

OTHER PUBLICATIONS

International Preliminary Report on Patentability from correspondence application No. PCT/EP2005/005634, mailed Nov. 29, 2006.

*Primary Examiner*—Dana Ross
(74) *Attorney, Agent, or Firm*—Fish & Richardson P.C.

(57) ABSTRACT

There is provided a counter-rotating spindle transmission. More specifically, in one embodiment, there is provided a punching machine comprising a tool bearing configured to mate with a punching tool, a rotary/lifting drive coupled to the tool bearing to move the tool bearing axially along a tool bearing lifting axis and to rotate the tool bearing about the lifting axis, the rotary/lifting drive comprising a first motor coupled to drive a first spindle transmission coupled to the tool bearing, a second motor coupled to drive a second spindle transmission coupled to the tool bearing, and a drive controller configured to independently and simultaneously drive both the first and second motors selectively in a common rotary sense and in a contra-rotary sense, to jointly move the tool bearing both axially and rotationally.

16 Claims, 6 Drawing Sheets

U.S. PATENT DOCUMENTS 6,280,124 B1 * 8/2001 Ammann ..... 408/129
6,445,971 B1 * 9/2002 Gottschalk et al. ..... 483/1
6,772,667 B2 * 8/2004 Phlipot ..... 83/684
6,860,683 B2 * 3/2005 Choi ..... 409/233
2003/0223834 A1 * 12/2003 Choi ..... 409/136

FOREIGN PATENT DOCUMENTS

JP 04-172133 6/1992

* cited by examiner

COUNTER-ROTATING SPINDLE TRANSMISSION

CROSS REFERENCE TO RELATED APPLICATIONS

This application is a continuation of, and claims priority under 35 U.S.C. §120 to PCT/EP2005/005634, filed on May 25, 2005 , and designating the U.S., and claims priority under 35 U.S.C. §119 from European application EP 04 012 521.3, filed May 27, 2004.

TECHNICAL FIELD

This invention relates to industrial equipment, and more particularly to machines and methods for working with workpieces, such as metal sheets.

BACKGROUND

As those of ordinary skill in the art will appreciate, punching machines may be employed to punch holes or other cutouts from a workpiece (e.g., a metal sheet). Typically, punching machines include a tool bearing for a punching tool and a rotary/lifting drive, which moves the tool bearing back and forth along a lifting axis to a working area of the punching machine. Also, the tool bearing is rotatably adjustable about the lifting axis. The punching machine may also include a motor-driven spindle transmission provided with a drive control system. Typically, a rotary/lifting drive having two electric drive motors is provided for the tool bearing of a punching machine. Both drive motors may be arranged laterally next to a drive spindle, which in turn runs in the direction of a lifting axis of the tool bearing. One of the drive motors serves for workpiece punching and for that purpose is connected via a belt drive to a lifting spindle nut disposed on the drive spindle. By driving this spindle transmission in one direction of rotation, the tool bearing (and hence the attached punching tool) is moved with working strokes towards the workpiece to be processed and then by reversing the motor, the tool bearing is moved in the opposite direction. The second drive motor in a conventional punching machine is intended for rotary adjustment of the tool bearing and the punching tool. This drive motor is connected via another belt drive to enable rotation of the punching tool relative to the lifting axis. A more efficient punching tool would be desirable.

SUMMARY

There is provided a counter-rotating spindle transmission for a punching machine. More specifically, in one embodiment, there is provided a rotary/lifting drive having coaxial yet contra-rotating spindle transmissions. In this embodiment, the spindle transmissions may be driven by separate drive motors. The motor-side spindle transmission elements of the contra-rotating spindle transmissions can be driven either in the same direction of rotation or in opposite directions of rotation. If the directions of rotation correspond, then the motor-side spindle transmission elements move jointly with the interlinked tool-side spindle transmission elements about the spindle transmission axis. In this way the tool bearing and the punching tool respectively is rotatably adjustable about the lifting axis with the desired orientation. The motor capacities of the individual drive motors are available for performing the rotary movement of tool bearing and punching tool.

However, if the motor-side spindle transmission elements run in opposite directions, then between the motor-side spindle transmission elements and the associated tool-side spindle transmission elements relative rotary movements occur, which in turn affect a displacement of the tool-side spindle transmission elements as well as the tool bearing and the punching tool in the direction of the spindle transmission axis and the lifting axis respectively. Owing to the coupling of the tool-side spindle transmission elements, the torques provided by the drive motors of the individual motor-side spindle transmission elements complement one another and a corresponding force can be exerted in the direction of the lifting axis on the punching tool. This axial force can be used in particular as punching force for workpiece processing, but the individual capacity of each motor to be installed is less than it would be when using a single drive motor having the same efficiency.

Moreover, when the contra-rotating motor-side spindle transmission elements have a corresponding rotational speed, a rotation-free movement of the tool-side spindle transmission elements in the direction of the spindle transmission axis, and hence a rotation-free movement of the punching tool in the direction of the lifting axis, can be produced without a separate means for preventing rotation of the punching tool. Alternatively, it may also be possible to match the speeds of the contra-rotating motor-side spindle transmission elements so that a movement of the tool-side spindle transmission elements and of the punching tool in the direction of the spindle transmission axis and the lifting axis respectively and a rotary movement about the spindle axis and the lifting axis respectively are superimposed. With a compact drive, a plurality of drive functions can therefore be realized with great efficiency.

In still another embodiment, the rotational speeds of the motor-side spindle transmission elements are controllable independently of each other by means of the drive control of the contra-rotating spindle transmissions. In this way, the movements of the tool bearing and the punching tool resulting from the rotary movement of the motor-side spindle transmission elements can be adapted with great flexibility to the requirements of the application concerned.

In still other embodiments, there are provided punching machines in which the motor-side spindle transmission elements of the contra-rotating spindle transmissions rotate in opposite directions of rotation. This mode of operation of the contra-rotating spindle transmissions may be selected to generate movements of the tool bearing and the punching tool in the direction of the lifting axis, especially for performing working strokes of the punching tool.

In yet another case, actual rotary adjustments of the tool bearing relative to the lifting axis may be detected. Depending on the detection result, the rotational speed of at least one motor-side spindle transmission element is controllable and in this way the rotary adjustment of the tool bearing can be influenced. For example, on start-up of the motor-side spindle transmission elements that are driven in opposite directions there is a slight change in the rotary adjustment of the tool bearing and the punching tool respectively, whereas on termination of the start-up phase, the rotary adjustment of the tool bearing and the punching tool respectively does not change anymore. The rotational speed of the motor-side spindle transmission elements reached after the start-up phase is to be maintained at a constant value by means of the evaluating and control unit of the drive control.

In still other situations, during the movement of the punching toot in the direction of the lifting axis a displacement of the punching tool about the lifting axis can be reversed. This embodiment may be useful when punching tools having a cross-sectional form other than circular are used. In these cases, the rotated position of the punching tool relative to the lifting axis is related to the processing result and of the feasibility of the workpiece processing.

In yet another embodiment, the desired rotary adjustment of the tool bearing and the punching tool respectively may be defined by that rotary adjustment that is present at the start of driving of the motor-side spindle transmission elements in opposite directions of rotation. In still other embodiments, a rotation-braking arrangement for the tool bearing may be provided (e.g., an electromotive rotation-braking arrangement). By means of this rotation-braking arrangement, the desired rotary adjustment of the tool bearing can be safeguarded. In the process, the rotation-braking arrangement may support the contra-rotating spindle transmissions, which, with appropriate control, may counteract an undesirable displacement of the tool bearing in the direction about the lifting axis.

In a further embodiment, contra-rotating spindle transmissions with uniform speed ratios may be provided. This standardization of the drive components produces a structurally simple configuration of the overall arrangement and also simplifies the drive control of the contra-rotating spindle transmissions. Still other aspects may include a rotary/lifting drive that has comparatively small dimensions in the radial direction of the spindle transmission axis or is relatively small in the direction of the spindle transmission axis. In still other embodiments, torque motors may also enable even high motor torques to be transferred without interposed gearing.

In still other examples, a one-piece construction of the tool-side spindle transmission elements may be provided to reduce the number of component parts. Further, in one embodiment a preloading arrangement (e.g., a pneumatic arrangement) in the direction of the spindle transmission axis may be provided for the tool-side spindle transmission elements of punching machines. Such preloading arrangements may increase the service life and the operational reliability of the rotary/lifting drive of punching machines according to the invention. For example, when the punching tool strikes the workpiece, when the punching tool penetrates the workpiece and during reversal of the stroke movement, load alternation may occur at the rotary/lifting drive. As such, in this embodiment, a preloading arrangement may counteract this sudden load alternation at the rotary/lifting drive with a swelling loading of the spindle transmission, causing less wear.

In still another configuration, there is provided a punching machine comprising a tool bearing configured to mate with a punching tool, a rotary/ling drive coupled to the tool bearing to move the tool bearing axially along a tool bearing lifting axis and to rotate the tool bearing about the lifting axis, the rotary/lifting drive comprising a first motor coupled to drive a first spindle transmission coupled to the tool bearing, a second motor coupled to drive a second spindle transmission coupled to the tool bearing, and a drive controller configured to independently and simultaneously drive both the first and second motors selectively in a common rotary sense and in a contra-rotary sense, to jointly move the tool bearing both axially and rotationally.

DESCRIPTION OF DRAWINGS

The details of one or more embodiments of the invention are set forth in the accompanying drawings and the description below. Other features, objects, and advantages of the invention will be apparent from the description and drawings, and from the claims.

Like reference symbols in the various drawings indicate like elements.

DETAILED DESCRIPTION

Figure 1:
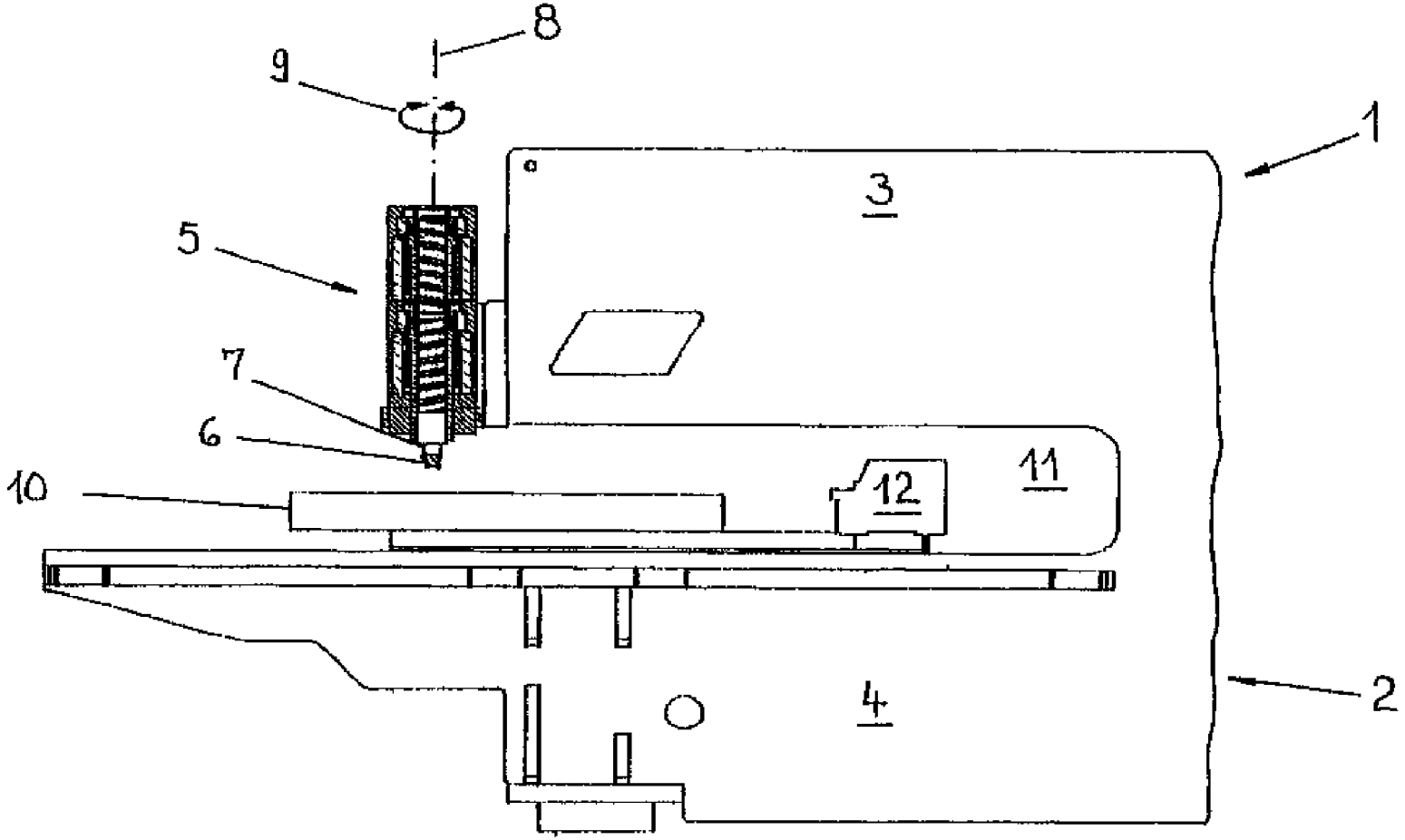
FIG. 1 shows a punching machine having a first construction of an electric rotary/lifting drive for a punch upper die in partially sectional side view.

As shown in FIG. 1, a punching machine 1 has a C-shaped machine frame 2 with an upper frame member 3 and a lower frame member 4. An electric rotary/lifting drive 5 for a processing tool in the form of a punch 6 is provided at the free end of the upper frame member 3. The punch 6 may be mounted in a tool bearing 7. The tool bearing 7 within the rotary lifting drive 5, is movable in a straight line jointly with the punch 6 in the direction of a lifting axis 8 and rotationally adjustable about the lifting axis 8 in the direction of a double arrow 9. Movements in the direction of the lifting axis 8 are performed by the tool bearing 7 and the punch 6 respectively during working strokes for processing workpieces and during return strokes following the working strokes. Rotary adjustment of the tool bearing 7 is performed to change the rotated position of the punch 6 relative to the lifting axis 8.

When machining a workpiece, in the example case when punching workpieces or sheets (not shown), the punch 6 co-operates with a punching lower tool (not shown) in the form of a die. This is integrated in the customary manner in a workpiece table 10, which in its turn is mounted on the lower frame member 4 of the punching machine 1. The relative movements of the relevant sheet that are required during machining of the workpiece relative to the punch 6 and the die may be performed by a coordinate guide 12 of customary construction housed in a gap area 11 of the machine frame 2.

Figure 2:
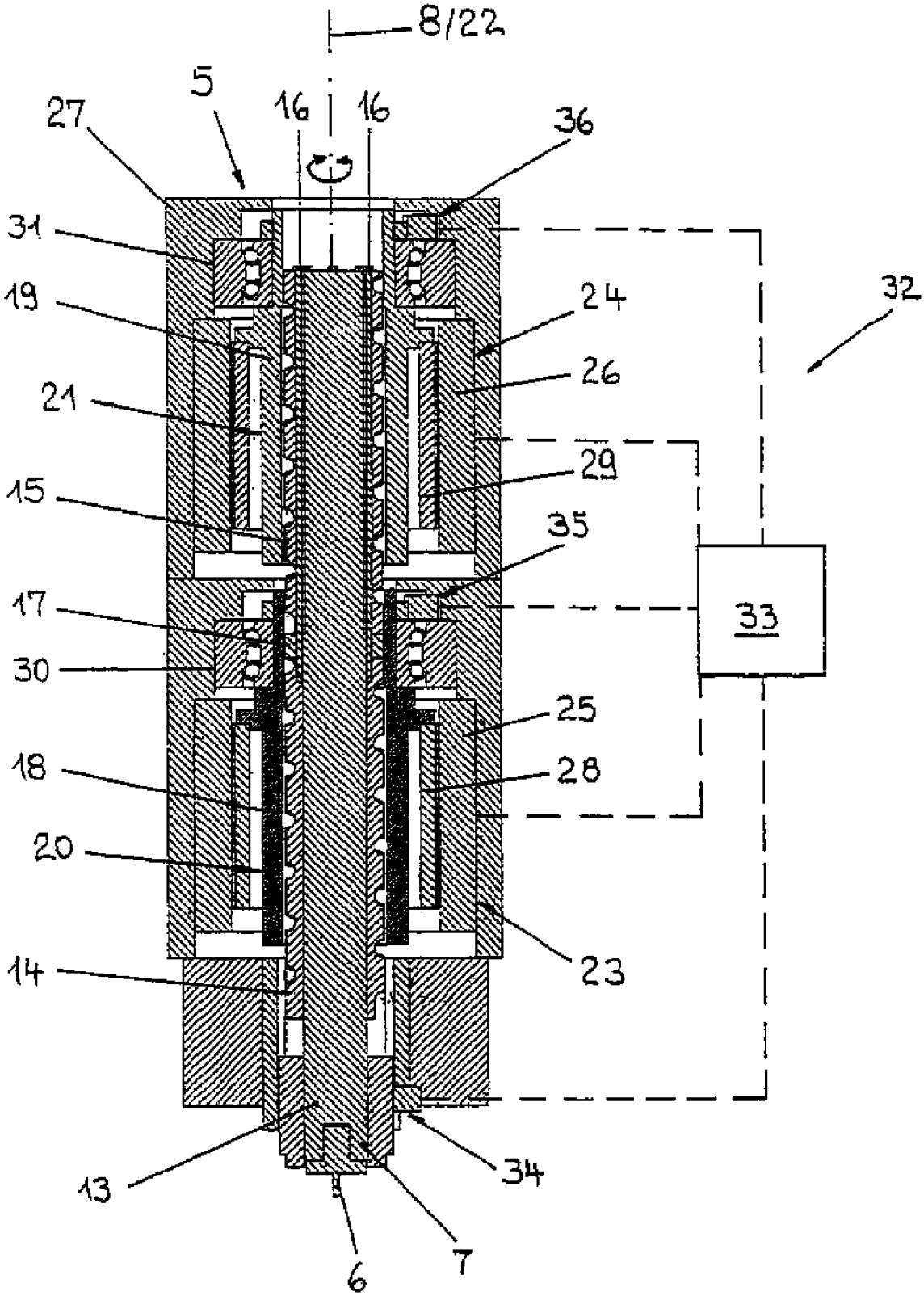
FIG. 2 shows a cross-sectional view of rotary/lifting drive in FIG. 1.

As can be inferred in detail from FIG. 2, the tool bearing 7 with the punch 6 is provided on a ram 13. The ram 13 passes through a first drive spindle 14 and a second drive spindle 15. In one embodiment, the drive spindles 14 and 15 are in the form of hollow spindles. The drive spindles 14, 15 may be connected to each other by connecting screws 16. The connecting screws 16 and the spindle nut 17 also pass through an external collar 17 of the ram 13. The drive spindles 14, 15 are therefore effectively fixed all round to each other and to the ram 13.

A first spindle nut 18 is located on the first drive spindle 14 and a second spindle nut 19 is located on the second drive spindle 15. Together with the first spindle nut 18 the first drive spindle 14 forms a first spindle transmission 20. Correspondingly, a second spindle transmission 21 comprises the second drive spindle 15 and the second spindle nut 19. The two spindle transmissions 20, 21 are constructed as contra-rotating ball screw transmissions of otherwise identical construction. A common spindle transmission axis 22 coincides with the lifting axis 8 of rotary/lifting drive 5.

A first electric drive motor 23 may be used to drive the first spindle transmission 20 and a second electric drive motor 24 may be used to drive the second spindle transmission 21. In one embodiment, the two drive motors 23, 24 are torque motors. A stator 25 of the first electric drive motor 23 as well as a stator 26 of the second electric drive motor 24 may be mounted on a drive housing 27 of the of the rotary/lifting drive 5. A rotor 28 of the first electric drive motor 23 may be gearlessly connected to the first spindle nut 18, while a rotor 29 of the second electric drive motor 24 is connected in a corresponding manner to the second spindle nut 19. Accordingly, the first spindle nut 18 and the second spindle nut 19 form motor-side spindle transmission elements, and the first drive spindle 14 and the second drive spindle 15 form tool-side spindle transmission elements of the spindle transmissions 20, 21. The spindle nut 18, the rotor 28 and the stator 25 as well as the spindle nut 19, the rotor 29 and the stator 26 may be arranged with a mutual overlap in the direction of the lifting axis 8 and spindle transmission axis 22, respectively. The spindle transmissions 20, 21 and the ram 13 with the tool bearing 7 and the punch 6 may be rotatably mounted on the drive housing 27 of the rotary/lifting drive 5 using customary rolling-contact bearings 30, 31.

The electric drive motors 23, 24 and via them also the spindle transmissions 20, 21 are independent of one another and in each case controllable both in their number of rotation and their angle of rotation respectively as well as in their direction of rotation. A drive control 32 may be provided for this purpose. For example, in one configuration, the drive control 32 is configured to independently and simultaneously drive electric drive motors 23, 24 selectively in the common rotary sense and in a contra-rotary sense (as described further below) to jointly move the tool bearing both axially and rotationally. In the illustrated embodiment, the drive control 32 is also integrated in the numeric overall control of the punching machine 1 via an evaluation and control unit 33. In one embodiment, it is connected to the electric drive motors 23, 24 and to sensor arrangements 34, 35, 36.

The sensor arrangement 34 serves to detect the angle of rotation and the rotary adjustment, as well as the direction of rotation respectively of the tool bearing 7 and the punch 6 relative to the lifting axis 8. The angle of rotation and rotational speed respectively, as well as the direction of rotation of the first spindle nut 18 may be detected by means of the sensor arrangement 35; whereas the angle of rotation and rotational speed respectively as well as the direction of rotation of the second spindle nut 19 may be detected by means of the sensor arrangement 36. All the sensor arrangements 34, 35, 36 are of customary construction and each comprises a stationary element connected to the drive housing 27 and a rotating element connected to the respective rotating component to be monitored.

Using the drive control 32, different operating modes of the rotary/lifting drive 5 can be implemented. For example, during processing of the workpieces by punching, the punch 6 is to be moved in the direction of the lifting axis 8 of the rotary/lifting drive 5 towards the workpiece to be processed. For that purpose, the spindle transmissions 20, 21 are driven by means of the electric drive motors 23, 24 at the same speed but in a contra-rotary sense (i.e., opposite directions of rotation). Owing to the opposite directions of rotation of the spindle nuts 18, 19 and on the basis of the inter alia rotationally secure connection of the drive spindles 14, 15, the latter do not change their rotated position relative to the lifting axis 8 during the described rotation of the spindle nuts 18, 19. Rather, the drive spindles 14, 15 are displaced jointly with the ram 13 and the punch 6 mounted thereon exclusively in the direction of the lifting axis 8 and in the process, as a result of the appropriately selected directions of rotation of the spindle nuts 18, 19, towards the workpiece to be processed. The motor torques made available by each of the electric drive motors 23, 24 complement one another, during working strokes there is a correspondingly high punching force available at the punch 6.

Moreover, owing to the coupling of the tool-side spindle transmission elements, the torques provided by the drive motors of the individual motor-side spindle transmission elements complement one another and a corresponding force can be exerted in the direction of the lifting axis on the punching tool. This axial force can be used in particular as punching force for workpiece processing, but the individual capacity of each motor to be installed is less than it would be when using a single drive motor having the same efficiency.

As those of ordinary skill in the art will appreciate, the angle of rotation of the punch 6 can be important, especially if the punch is non-circular. If at the start of a punching stroke, i.e. at the start of driving the spindle nuts 18, 19 in opposite directions, the punch 6 is arranged with its desired rotary orientation relative to the lifting axis 8, then it is desirable for this orientation to be maintained when the punch 6 strikes the workpiece. For that purpose, during the punching strokes the rotary adjustment or the angle of rotation respectively of the punch 6 relative to the lifting axis 8 must be monitored by a sensor arrangement 34. If the angle of rotation detected by the sensor arrangement 34 assumes a value other than zero, then by means of the evaluating and control unit 33 may adjust the speed of at least one of the drive motors 23, 24 such that the desired rotary orientation of the punch 6 is reinstated. In one embodiment, the number of rotation and rotational speeds respectively of the drive motors 23, 24 and the spindle nuts 18, 19 respectively may be monitored by the sensor arrangements 35, 36. In other embodiments, the sensor arrangements 35, 36 may be used for controlling the angles of rotation and directions of rotation of the spindle nuts 18, 19, and hence for controlling the magnitude and the direction of the strokes performed by the drive spindles 14, 15 and by the punch 6.

On termination of a punching stroke, by reversing the direction of the electric drive motors 23, 24, a reverse stroke of the punch 6 may be performed. In particular, the electric drive motors 23, 24 and the spindle transmissions 20, 21 respectively may be operated with opposing directions of rotation to enable the punch 6 to perform the reverse stroke. Both in the case of the punching or working strokes and in the case of the reverse strokes following the working strokes, the opposing directions of rotation of the spindle nuts 18, 19 cause the drive spindles 14, 15 and with them the ram 13 and the punch 6 mounted thereon to substantially maintain their orientation about the lifting axis 8. If minor orientation corrections are needed, they can be carried out in the above-described manner. As such, both spindle transmissions 20, 21 may act as an anti-rotation system for the drive spindles 14, 15, obviating a need for a separate dedicated anti-rotation device (although in some embodiments, a separate anti-rotation device may be employed).

If the orientation of the punch 6 relative to the lifting axis 8 is to be changed, then the electric drive motors 23, 24 and with them the spindle transmissions 20, 21 can be operated with corresponding directions of rotation. The drive spindles 14, 15, as well as the punch 6 connected thereto secure against rotation, are entrained in the direction of rotation by the spindle nuts 18, 19 rotating in the same direction about the lifting axis 8. The rotary adjustment of the punch may be monitored by the sensing device 34, which recognizes when the desired angle of rotation of the punch 6 has been reached.

By way of the evaluating and control unit 33, the rotary drive of the punch 6 is stopped when the desired rotary adjustment is reached. If necessary, the rotated position of the die associated with the punch 6 may also be changed.

Further, in some embodiments, a superimposition of rectilinear movements of the punch 6 in the direction of the lifting axis 8 and of rotary movements of the punch 6 about the lifting axis 8 is also possible. For that purpose, the spindle transmissions 20, 21 may be operated by the electric drive motors 23, 24 in opposite directions of rotation and at different speeds of rotation and numbers of rotation respectively. The direction of rotation of the punch 6 and the drive spindles 14, 15 respectively is here determined by the "faster" of the spindle nuts 18, 19. In this mode of operation, the rotated position or the angle of rotation of the punch 6 may also monitored by the sensor arrangement 34, and controlled by changing the speed of one of the drive motors 23, 24.

Figure 3:
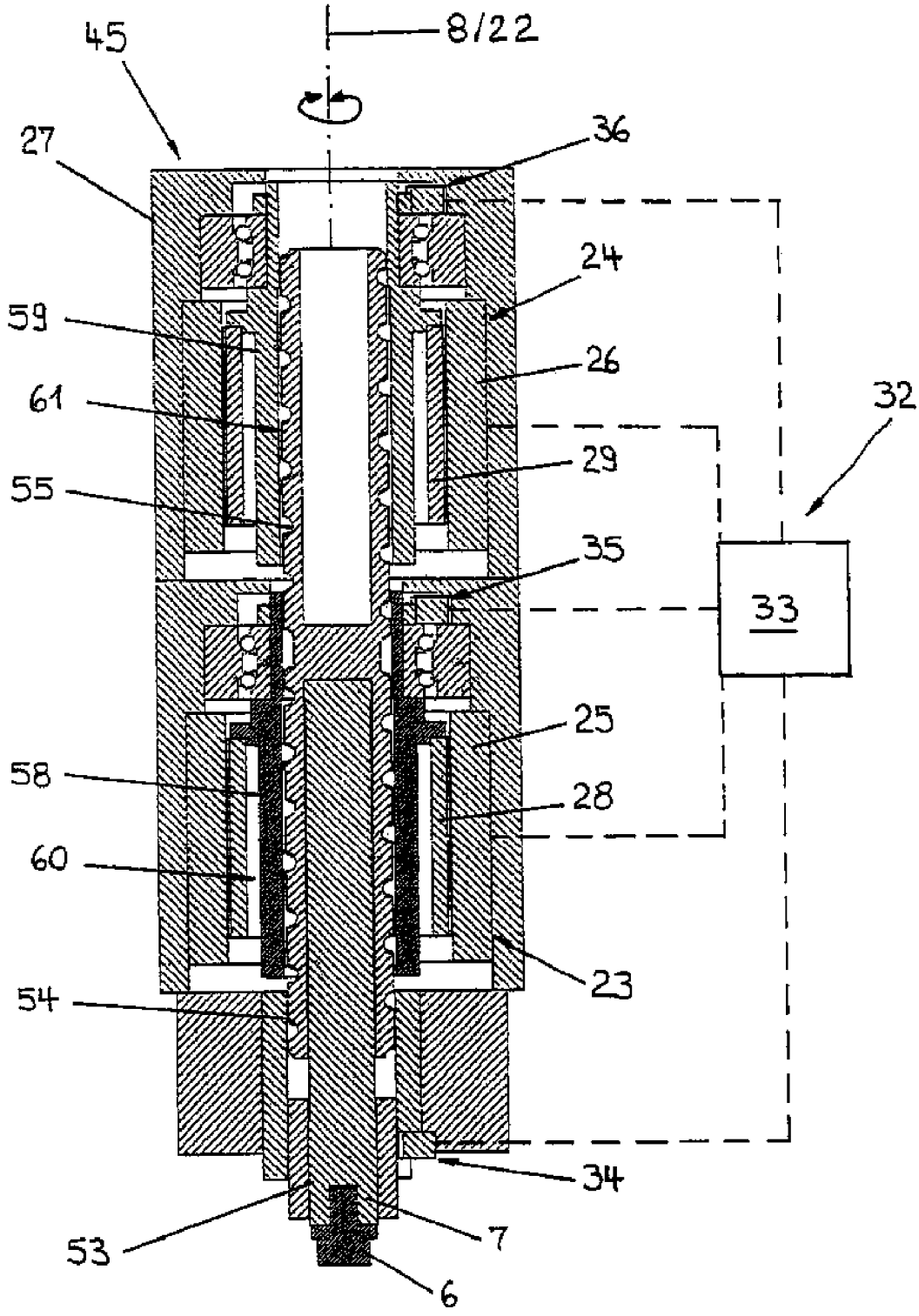
FIG. 3 shows a cross-sectional view of a second embodiment of an electric rotary/lifting drive for a punch upper die of a punching machine.

FIG. 3 illustrates another embodiment with a rotary/lifting drive 45 that differs from the rotary/lifting drive 5 shown in FIG. 2 in the configuration of drive spindles 54, 55 and their connection to the tool bearing 7 and the punch 6. Unlike the drive spindles 14, 15 according to FIG. 2, the drive spindles 54, 55 according to FIG. 3 form a one-piece modular unit. A ram 53 is fixed inside the axial seat of the drive spindle 54. Jointly with motor-side spindle transmission elements in the form of spindle nuts 58, 59, the drive spindles 54, 55, as tool-side spindle transmission elements, form contra-rotating spindle transmissions 60, 61. Otherwise, on account of the given structural and functional conformity, the same reference numerals are used in FIGS. 2 and 3.

Figure 4:
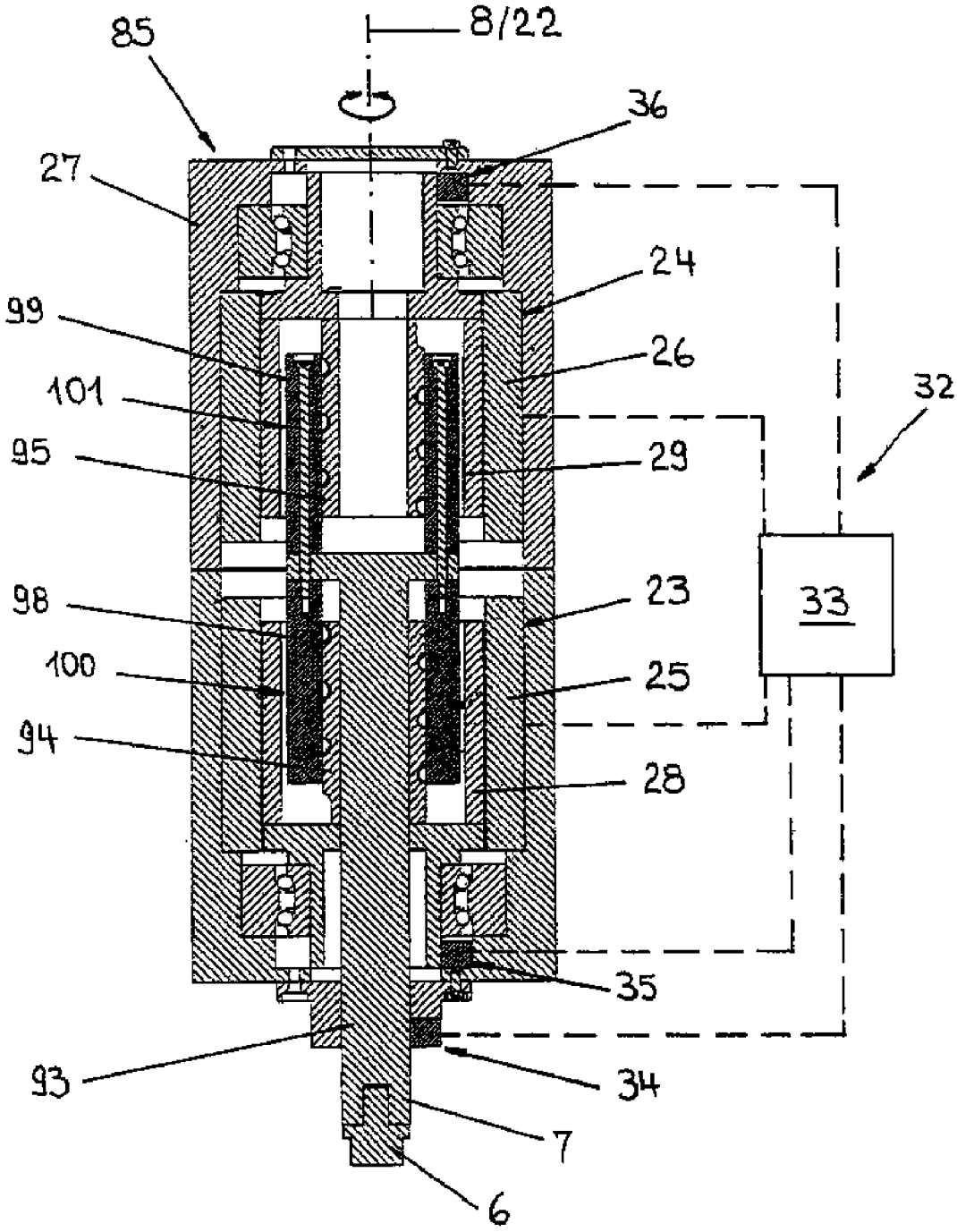
FIG. 4 shows a cross-sectional view of a third embodiment of an electric rotary/lifting drive for a punch upper die of a punching machine.

FIG. 4 shows an embodiment wherein a rotary/lifting drive 85 having spindle transmissions 100, 101, which are constructed with the conditions according to FIGS. 2 and 3 being kinematically reversed. Thus, in the case of the rotary/lifting drive 85, a first drive spindle 94 may be directly connected to the rotor 28 of the first electric drive motor 23 and a second drive spindle 95 is directly connected to the rotor 29 of the second electric drive motor 24. A first spindle nut 98 and a second spindle nut 99 are coupled to one another and mounted on a ram 93 equipped with the tool berg 7 and the punch 6. Accordingly, in the case of the rotary/lifting drive 85 the motor-side spindle transmission elements are formed by the drive spindles 94, 95, and the tool-side spindle transmission elements are formed by the spindle nuts 98, 99. Otherwise, the rotary/lifting drive 85 corresponds in construction and mode of operation 93 essentially to the rotary/lifting drives 5, 45 according to FIGS. 2 and 3, and, as such, corresponding reference numerals are provided in FIG. 4.

Figure 5:
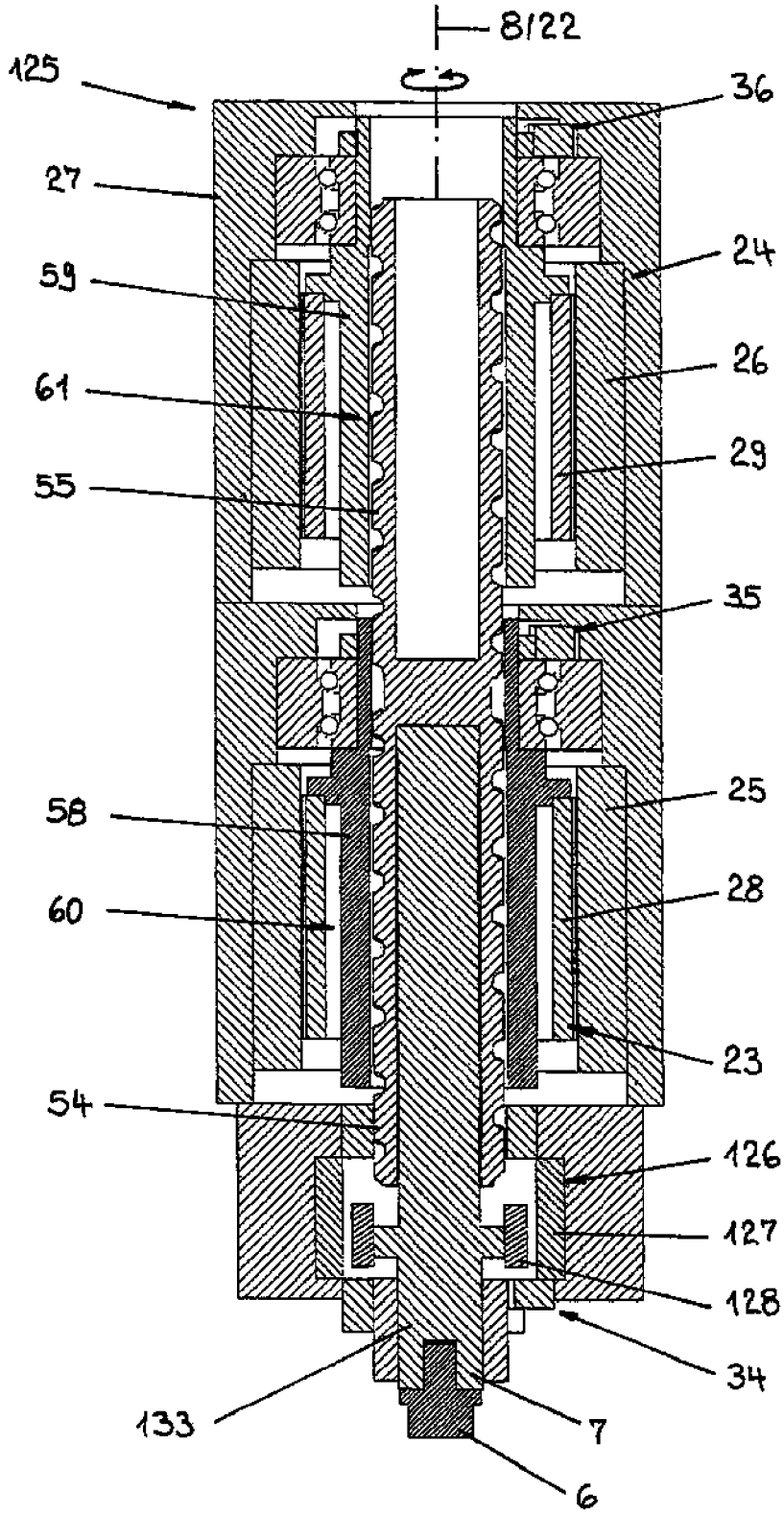
FIG. 5 shows a cross-sectional view of a fourth embodiment of an electric rotary/lifting drive for a punch upper die of a punching machine.

FIG. 5 illustrates a rotary/lifting drive 125 that is largely consistent with the rotary/lifting drive 45 according to FIG. 3. However, unlike the rotary/lifting drive 45, the rotary/lifting drive 125 also includes a rotation-braking arrangement 126 for the tool bearing 7 and the punch 6 respectively. In one embodiment, the rotation-braking arrangement 126 is in the form of an electric motor and has a stator 127 mounted on the drive housing 27 and a rotor 128 connected to a ram 133. The rotation-braking arrangement 126 is connected to the drive control of the punching machine 1.

As illustrated, the rotation-braking arrangement 126 is activated throughout the entire period of operation of the rotary/lifting drive 125. Accordingly, the rotation-braking arrangement 126 may generate a braking force continuously that is directed opposite to a rotation of the ram 133 and the tool bearing 7 and the punch 6 respectively about the lifting axis 8. The rotation-braking arrangement 126, thus, may support the spindle transmissions 60, 61 operated in opposite directions when securing the tool bearing 7 and the punch 6 respectively against an undesirable rotary movement about the lifting axis 8. If the spindle transmissions 60, 61 are operated in the same direction to change the rotary adjustment of the tool bearing 7 and the punch 6, then the braking force exerted by the rotation-braking arrangement 126 is to be overridden by the electric drive motors 23, 24. Alternatively, in one embodiment, the rotation-braking arrangement 126 may be activated only during operation of the spindle transmissions 60, 61 in opposite directions. For example, a rotation-braking arrangement that generates the braking force to be exerted on the tool bearing 7 and the punch 6 mechanically, (e.g., force-fit clamping) may also be employed.

Figure 6:
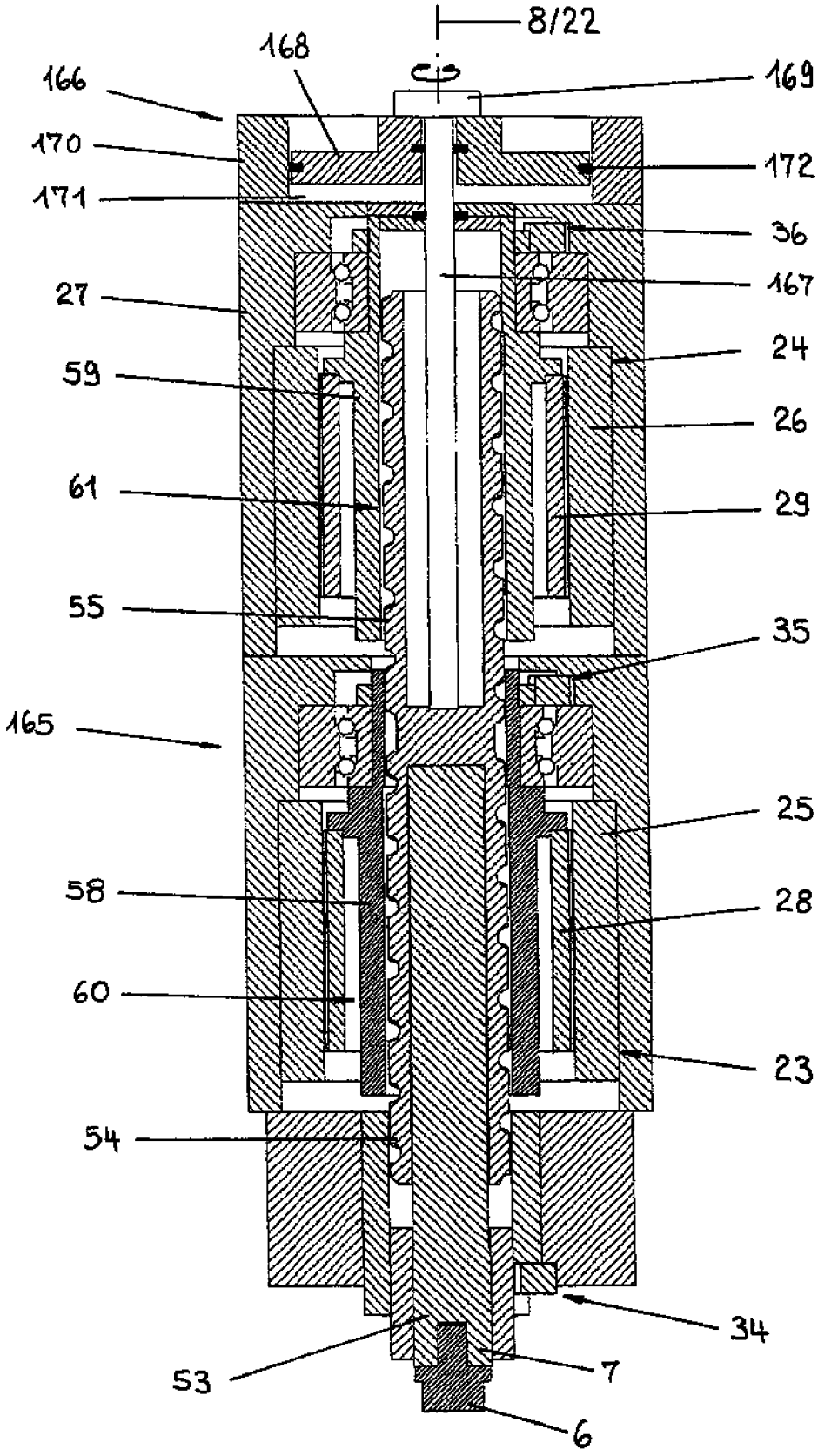
FIG. 6 shows a cross-sectional view of a fifth embodiment of an electric rotary/lifting drive for a punch upper die of a punching machine in longitudinal section.

A rotary/lifting drive 165, as shown in FIG. 6 corresponds in its construction largely to the rotary/lifting drive 45 according to FIG. 3. However, in addition to the components of the rotary/lifting drive 45, the rotary/lifting drive 165 is equipped with an axial preloading arrangement 166. The axial preloading arrangement 166 includes a plunger 167, which at one end is connected to the structural unit formed by the drive spindles 54, 55 and which with its opposite axial end passes through a piston 168 and rests with a radial projecting end 169 on the latter. The piston 168 is movably guided in the direction of the spindle transmission axis 22 in a cylindrical ring 170 provided on the drive housing 27. The plunger 167 is rotatable about its longitudinal axis relative to the piston 168. A pressure space 171 formed between the piston 168 and the drive housing 27 and the cylindrical ring 170 respectively is filled with air and is sealed with respect to its surroundings by sealing elements 172.

During punching of the workpiece, the structural unit comprising drive spindle 54 and drive spindle 55 may move downwards in the direction of the lifting axis 8 and spindle transmission axis 22, respectively. The plunger 167 connected to the drive spindles 54, 55 performs a movement in the same direction and entrains the piston 168 with it. The air in the pressure space 171 may consequently be compressed. Via the piston 168 and the plunger 167, the compressed air in the pressure space 171 exerts a force directed upwardly in the direction of the lifting axis 8 and the spindle transmission axis 22 on the drive spindles 54, 55 and via these on the tool bearing 7 and the punch 6.

When the workpiece to be processed is subjected to the action of the punch 6, a force likewise directed upwardly in the direction of the lifting axis 8 and the spindle transmission axis 22 builds up in the components of the rotary/lifting drive 165 connected to the punch 6. When the punch 6 penetrates the workpiece, then the punch 6 and the components of the rotary/lifting drive 165 connected to it attempt to perform a movement directed downwardly in the direction of the lifting axis 8 and the spindle mission axis 22. Such a sudden movement is prevented by the preload force exerted by the axial preloading arrangement 166 specifically, by the compressed air in the pressure space 171. The command of control and regulation of the operating state of the rotary/lifting drive 165 may be characterized by an alternation of load when the workpiece being processed is penetrated by the punch 6 is thereby simplified.

In an alternate embodiment, a pressure space that is connected to a pressure control arrangement may be employed instead of the sealed pressure space 171. Moreover, in still other embodiments, an alternative to air used in the example case shown, other pressure media, preferably of a gaseous nature, are possible. Furthermore, the plunger piston 167 may also serve as part of a rotation-braking arrangement of the kind described with reference to FIG. 5.

Additional description of one or more of the features described above may be provided in commonly assigned U.S.

patent application Ser. No. 11/563,582, entitled PUNCH TOOL LIFT SPINDLE, filed on Nov. 27, 2006 (Our Ref. 15540-099001), and/or commonly assigned U.S. patent application Ser. No. 11/563,613, entitled SPINDLE DRIVE SUPPORT, filed on Nov. 27, 2006 (Our Ref. 15540-100001). Both of these applications are hereby incorporated by reference.

A number of embodiments of the invention have been described. Nevertheless, it will be understood that various modifications may be made without departing from the spirit and scope of the invention. For example, in alternate embodiments, other suitable motors or transmission types may be used. Accordingly, other embodiments are within the scope of the following claims.

What is claimed is:

1. A punching machine comprising:

a tool bearing configured to mate with a punching tool; and a rotary/lifting drive coupled to the tool bearing to move the tool bearing axially along a tool bearing lifting axis and to rotate the tool bearing about the lifting axis, the rotary/lifting drive comprising:

a first motor coupled to drive a first spindle transmission coupled to the tool bearing;

a second motor coupled to drive a second spindle transmission coupled to the tool bearing; and a drive controller configured to independently and simultaneously drive both the first and second motors selectively in a common rotary sense and in a contra-rotary sense, to jointly move the tool bearing both axially and rotationally.

2. The punching machine of claim 1, wherein the first and second spindle transmissions are simultaneously operable in the contra-rotary sense to non-rotationally displace the tool bearing axially along the lifting axis.

3. The punching machine of claim 1, wherein the first spindle transmission is at least partially located within a stator of the first motor and the second spindle transmission is at least partially located within a stator of the second motor.

4. The punching machine of claim 1, wherein the first spindle transmission is gearlessly connected to a rotor of the first motor.

5. The punching machine of claim 1, comprising a sensor arrangement for detecting rotation of the tool bearing relative to the lifting axis when the first motor and the second motor are in a contra-rotary sense, wherein the sensor arrangement is coupled to the rotary/lifting drive and wherein the drive controller is configured to control the first motor and the second motor based on the detected rotation of the tool bearing.

6. The punching machine of claim 5, wherein drive controller is configured to adjust a rotational speed of either the first motor or the second motor to substantially eliminate the detected rotation.

7. The punching machine of claim 1, wherein the first motor and the second motor are configured such that driving the first motor and the second motor in common rotary sense rotates the tool bearing about the lifting axis.

8. The punching machine of claim 1, wherein the first motor and the second motor are configured such that driving the first motor and the second motor in the contra-rotary sense at substantially different speeds rotates the tool bearing about the lifting axis.

9. The punching machine of claim 1, comprising a rotation braking arrangement configured to prevent rotation of the tool bearing.

10. The punching machine of claim 9, wherein the rotation braking arrangement comprises an electromotive rotation braking arrangement.

11. The punching machine of claim 1, wherein the first spindle transmission and the second spindle transmission have substantially uniform speed ratios.

12. The punching machine of claim 1, wherein the first spindle transmission comprises a first spindle and the second spindle transmission comprises a second spindle, wherein the first spindle and the second spindle form a one-piece modular unit.

13. The punching machine of claim 1, comprising:

an axial preloading arrangement configured to apply a preloading force that counteracts movement of the first and second spindle transmissions during a operation.

14. The punching machine of claim 13, wherein the axial preloading arrangement comprises a pneumatic preloading arrangement.

15. A method of operating a punch machine comprising a punch, the method comprising:

initiating a stroke of the punch towards a workpiece;

measuring a rotary angle of the punch during the initiated stroke;

determining if the measured rotary angle matches a predetermined rotary angle; and if the measured rotary angle does not match the predetermined rotary angle, adjusting the speed of one or more motors coupled to the punch before the punch makes contact with the workpiece on the initiated stoke, wherein adjusting the speed of the one or more motors changes the rotary angle of the punch.

16. . The method of claim 15, wherein determining if the measured rotary angle is matches a predetermined rotary angle comprises determining if the measured rotary angle is substantially zero.

* * * * *